US005657623A

United States Patent [19]

Mack et al.

[11] Patent Number: 5,657,623

[45] Date of Patent: Aug. 19, 1997

[54] ROVING FRAME WITH FLYERS AT EACH WORK STATION AND WITH PRESSING FINGERS ON EACH FLYER OPERATED BY A ROD EXTENDING ALONG A FLYER ARM OFFSET FROM THE PIVOT AXIS OF THE FINGER FOR SWINGING THE FINGER

[75] Inventors: Karl-Heinz Mack, Weilheim; Karl-Heinz Zettler, Reutlingen; Hans-Peter Weeger, Hattenhofen; Jörg Hummel, Ebersbach, all of Germany

[73] Assignee: Zinser Textilmaschinen GmbH, Ebersbach/Fils, Germany

[21] Appl. No.: 571,375

[22] Filed: Dec. 13, 1995

[30] Foreign Application Priority Data

Dec. 14, 1994 [DE] Germany ..... 44 44 452.4
Jul. 26, 1995 [DE] Germany ..... 195 27 341.9

[51] Int. Cl.[6] ..... D01H 1/04; D01H 7/24

[52] U.S. Cl. ..... 57/67; 57/68; 57/115; 57/117; 57/267

[58] Field of Search ..... 57/267, 67, 68, 57/71, 115, 116, 117, 118

[56] References Cited

U.S. PATENT DOCUMENTS

| | | | |
|---|---|---|---|
| 4,313,299 | 2/1982 | Gunkinger et al. | 57/267 |
| 5,170,616 | 12/1992 | Genevray | 57/267 |
| 5,197,272 | 3/1993 | Frey | 57/267 |
| 5,375,405 | 12/1994 | Weeger | 57/67 |
| 5,522,210 | 6/1996 | Mack | 57/67 |

FOREIGN PATENT DOCUMENTS

| | | |
|---|---|---|
| 486 416 | 5/1992 | European Pat. Off. . |
| 930 917 | 7/1955 | Germany . |

*Primary Examiner*—William Stryjewski
*Attorney, Agent, or Firm*—Herbert Dubno

[57] ABSTRACT

A roving frame has operating elements which engage rods mounted on a shank of each flyer of a flyer rail transversely to the pivot axis of the rod which is offset from the rod. The pressing fingers are swingable about this axis and can be urged outwardly to clear the bobbins and thus allow bobbin replacement.

23 Claims, 11 Drawing Sheets

FIG. 2
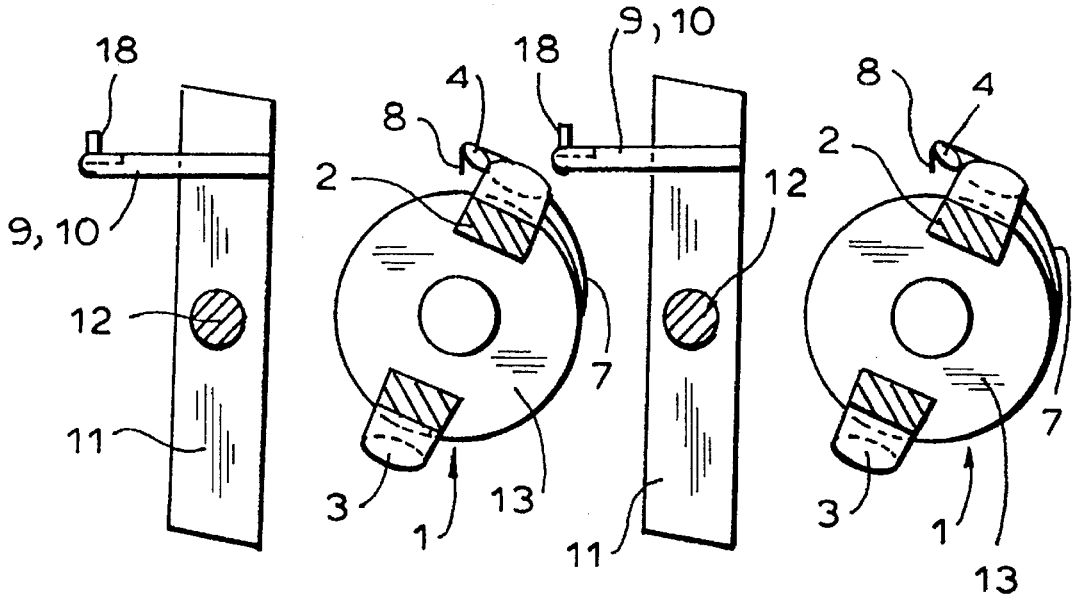
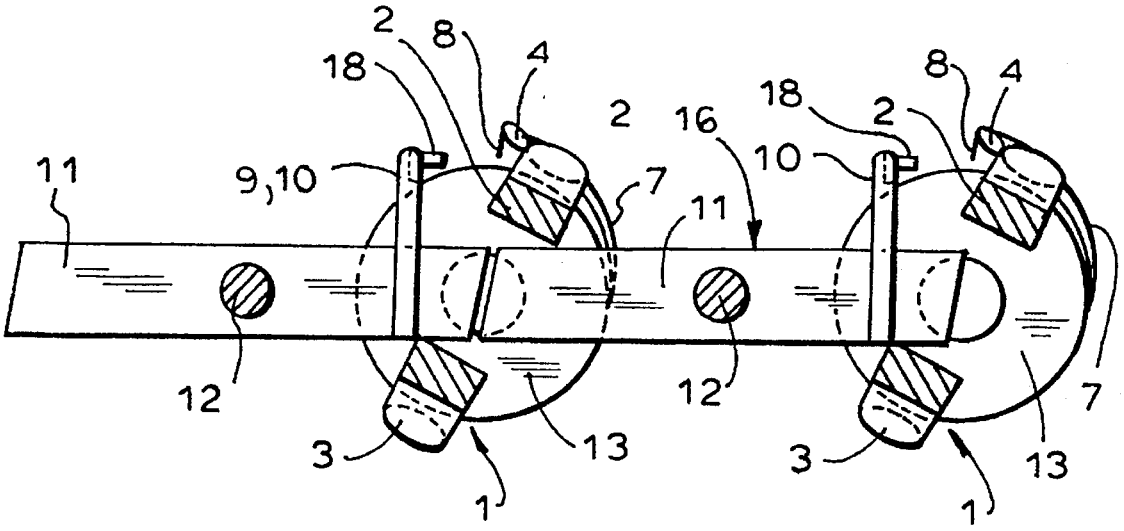
FIG. 3

ROVING FRAME WITH FLYERS AT EACH WORK STATION AND WITH PRESSING FINGERS ON EACH FLYER OPERATED BY A ROD EXTENDING ALONG A FLYER ARM OFFSET FROM THE PIVOT AXIS OF THE FINGER FOR SWINGING THE FINGER

FIELD OF THE INVENTION

Our present invention relates to a roving frame, i.e. a machine for the spinning of roving, having a flyer at each work station. More particularly, the invention relates to a roving frame having at least one row of work stations at each of which a respective bobbin sleeve can be mounted on a respective spinning spindle to form a bobbin and at which a respective flyer has a pair of flyer arms or shanks straddling the bobbin. In particular, the invention relates to a roving frame of the latter type in which on one of the shanks or arms of each flyer, a pressing finger is mounted on a rod diposed outside a pivot axis and cooperating with a device on the machine for holding the pressing finger in an outwardly swung position.

BACKGROUND OF THE INVENTION

A roving frame having flyers with pressing fingers is disclosed in German Patent 930,917. In this configuration, the pressing finger is spring-loaded toward the flyer axis and has a hand-actuated detent device which can serve to hold the pressing finger in an outwardly swung position. The detent device is comprised of a lever and a recess in an upper region of the flyer. With this construction, in which the flyer is placed upon the spindle and for bobbin change must be lifted from it by hand, manual operation of the pressing finger to swing it into its outwardly-swung or inactive position enables the pressing fingers to be so swung before the flyer is removed from the bobbin.

Mention may also be made of a roving frame as described in EP 0 486 416 A1 in which the pressing finger is actuated on the flyer by a brush-like device to swing the pressing finger from its working position. The brush device must be movable back and forth along the flyer arm or shank which results in a comparatively complex structure with relatively high construction and servicing costs.

OBJECTS OF THE INVENTION

It is the principal object of the present invention to provide an improved roving frame of the type described, i.e. having at least one row of work stations each with the respective spindle for forming a bobbin and a flyer for guiding the roving to the bobbin in the roving spinning process and a pressing finger on one shank or arm of each flyer, whereby drawbacks of the earlier systems can be obviated.

Another object is to provide an improved pressing finger operating mechanism for a roving frame of the type described whereby, in a relatively simple manner and at low construction and service costs, all of the pressing fingers of a row can be simultaneously and automatically swung outwardly into their inoperative positions, held in their outwardly swung positions and released to swing inwardly into the operative positions required.

SUMMARY OF THE INVENTION

These objects and others which will become apparent hereinafter are attained, in accordance with the invention, in a roving frame having at least one row of work stations, each of which is provided with a respective spindle for forming a roving bobbin, a flyer for feeding the roving onto the respective bobbin and having a pair of shanks or arms straddling the bobbin, a pressing finger on one arm of each flyer swingable between an inwardly swung or working position in which the finger presses against the bobbin and an outwardly-swung position in which the finger clears the bobbin to allow removal of a full bobbin and replacement on the spindle by a bobbin sleeve or core, and a rod on the arm of the flyer connected to the pressing finger and spaced from the pivot axis of the pressing finger by means of which the pressing finger can be activated. According to the invention, the device cooperating with the arm for holding the pressing finger in its outwardly-swung position has an actuating element which acts upon the rod transverse to the aforementioned pivot axis.

More particularly, a roving frame according to the invention can comprise:

- a support;
- at least one row of spindles on the support for receiving respective bobbins for spinning respective rovings at respective work stations;
- a respective flyer at each of the stations cooperating with the spindle and having:
  - a flyer body at an end of the flyer and rotatable about a rotation axis aligned with the respective bobbin, and
  - a pair of shanks straddling the respective bobbin;
- a respective pressing finger pivotally mounted on one of the shanks of each flyer swingable about a pivot axis toward and away from the respective bobbin for pressing turns of spun roving thereagainst in an inwardly swung position of the finger;
- a pressing finger rod carrying the pressing finger and offset from the pivot axis, the rod extending from the pressing finger along the one of the shanks; and
- a device cooperating with the pressing finger rods of the flyers and including a respective operating element engaging each rod transversely to the respective rod for retaining the pressing fingers of the flyers in respective outwardly swung positions of the flyers.

As a consequence of the configuration of the device of the invention and its cooperation with the pressing finger rods of all of the flyers of a row, a comparatively complex construction is provided which can ensure reliable outward swinging of the fingers into their inoperative position and return of the fingers into their inwardly-swung operative positions as required. Since the pressing finger rod is disposed outwardly of the pivot axis of the pressing finger, a force or pressure applied to this rod generates a torque about the pivot axis for swinging the pressing finger.

The rod can be formed with a lever which is engaged by the operating element upon rotation of the flyer to provide the force required to swing the pressing finger outwardly.

According to a feature of the invention, the respective actuating elements can be arranged on a holder which can be displaced to dispose the actuating elements in the path of sheet metal lugs formed on the rods when the pressing fingers are to be swung outwardly.

The invention has been found to be particularly effective when applied in conjunction with the use of rail segments which can be aligned along the row to permit carriages for the full bobbins and replacement cores or sleeves to be displaced along the row during the bobbin change process. In that case, the operating elements can be carried by the displaceable rail segments.

In a construction in which each flyer is associated with a rail segment, each of the rail segments can have a respective operating element which can be in the form of an abutment cooperating with a respective lever on the rod of the respective flyer or connected with the operating element in a more complex manner. According to the invention the pressing finger can be fixed by the operating device in the outwardly-swung position.

Alternatively, abutments can be provided, for example, in the form of cams or guide curves or curved surfaces or as part of a linkage system to be interposed into the paths of the respective levers. The interposition of the operating elements in the paths of the rods or the levers formed thereon can be effected by a shifting or linear movement of the actuating elements or a rotary movement thereof or of a combination of linear and rotary components of movement with, of course, the rotary movement of the respective flyer.

In a roving machine having two rows of work stations and hence two flyer rows, a common path shaft between the two rows can be provided and can have cams or guide curves at 180° to one another for engagement with the flyers of the two rows.

Alternatively two parallel linearly shiftable actuating rods can be provided, movable in the opposite directions and carrying respective curved surfaces for the one and the other flyer rows with the guide surfaces of the two rods being offset by 180° to one another.

The guide curve can be formed as part of a deflection plate which can be connected by intermediate elements with an actuating rail, and when two rows of work stations are provided, two parallel oppositely-movable actuating rails are provided. The operating element for holding the pressing finger in its outwardly-swung position can also be formed as an arm of a double-arm lever, each arm of which cooperates with a respective flyer in each of the two rows.

BRIEF DESCRIPTION OF THE DRAWING

The above and other objects, features, and advantages will become more readily apparent from the following description, reference being made to the accompanying drawing in which:

FIG. 2, FIG. 3 and FIG. 4 are cross sectional views from above in a spindle row showing two work stations and respective positions of the flyers and rail segments;

SPECIFIC DESCRIPTION

Figure 1:
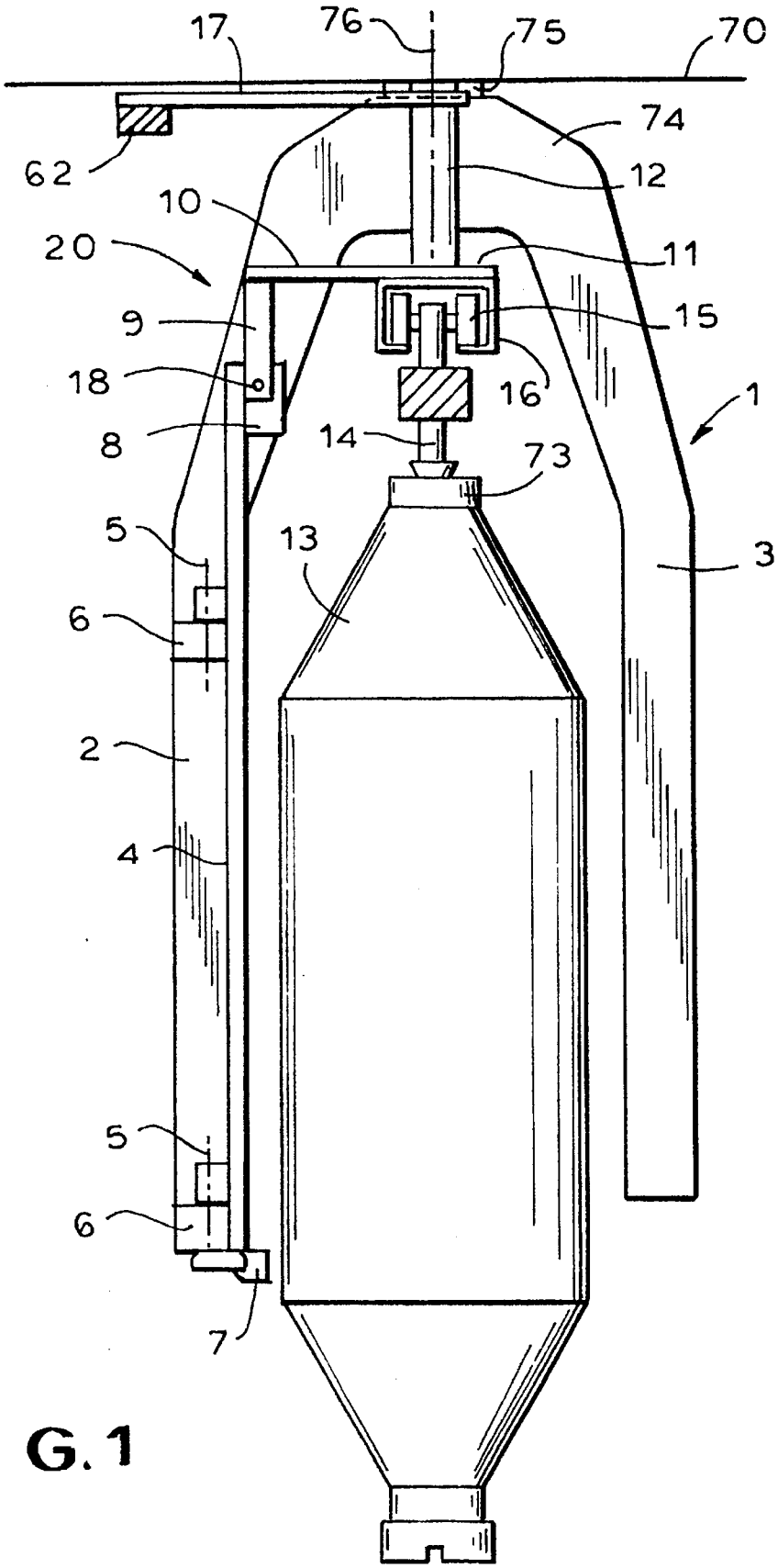
FIG. 1 is a diagrammatic side view of a portion of one work station in a roving machine having a plurality of such stations and seen in line with the row of flyers, the pressing finger being in an outwardly-swung position.
Figure 5:
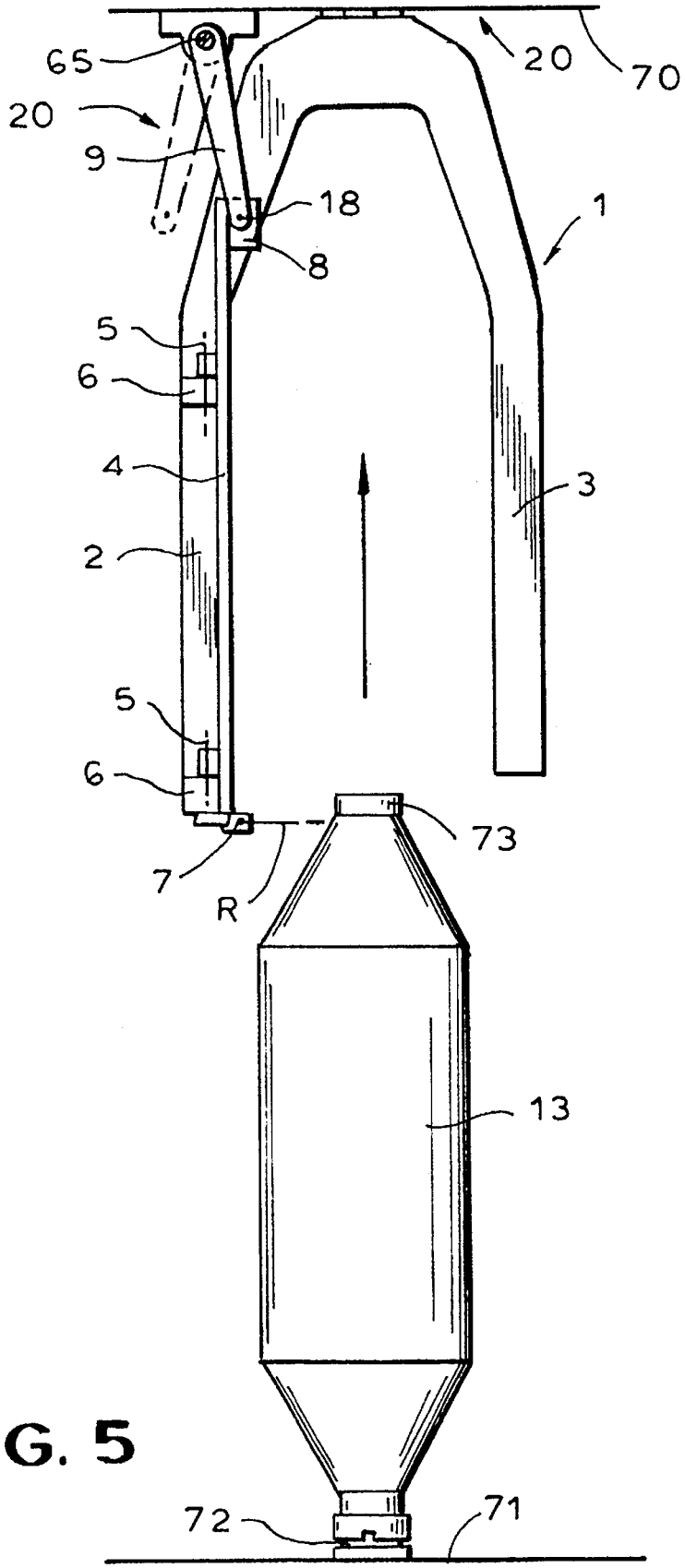
FIG. 5 is a view similar to FIG. 1 illustrating another embodiment of the mechanism for swinging the pressing finger outwardly.

In FIG. 1 we have shown a row of flyers 1, only one of which is visible, on a support 70, the row being seen from the end so that the flyers will be understood to be disposed one behind the other. Each of the flyers 1 is located at a respective working station of the roving frame, other portions of which have not been illustrated. It will be understood that the typical roving frame does include a spindle rail provided with a multiplicity of spindles each adapted to build a respective bobbin 13 from a roving which is fed from the drafting frame above the spindle rail and not shown in the present drawing. The roving is fed by the flyer 1 to the bobbin and a stretch of the roving is shown at R in FIG. 5 where the spindle rail is represented at 71 and a spindle at 72. The bobbin is built upon a core sleeve 73.

Each flyer 1 has a pair of flyer arms or shanks 3 which straddle the respective bobbin 13 and extend downwardly from a bight of the flyer as shown at 74, the flyer being journaled by the bight at 75 on the support 70 and being rotated as is customary in roving frames about an axis 76 corresponding to the respective spindle axis.

On one of the arms or shanks 2 of each flyer, journals 6 are provided by means of which a pressing finger rod 4 is mounted to swing about a pivot axis 5 on the flyer. As can be seen from FIG. 1, the rod 4 is offset from the axis 5. At the lower end, each rod 4 carries a pressing finger 7 which, during the building of the bobbin and the raising and lowering of the bobbin relative to the flyer to form the bobbin 13, the pressing finger is swung in its inwardly swung or operating position to press the roving which is deposited in layers on the bobbin against the body of the latter.

As is known in connection with roving frames, the removal of the full bobbins and the replacement of the full bobbins by empty bobbin cores or sleeves 73 can be effected with the aid of hangers 14 which depend from suspension carriages 15 of a train displaceable in a track 16 which, as will be described in greater detail, can be formed by aligning a multiplicity of rail segments. The bobbins can be raised into engagement with the hangers 14, whereupon the train of full bobbins can be removed from the row and replaced by a train of empty bobbins which, in an upper position of the spindle rail 71, can receive the empty sleeves for winding of new bobbins.

The pressing finger rod 4 is provided at its upper end with the lever 8 which can be located in the path of an operating element 9 affixed to a holder 10. The lever 8 can be a sheet metal lug which has a circular orbit about the axis of the flyer and, when the operating element 9 is introduced into this orbit, can be engaged to swing the finger 7 into its outwardly swung position about the axis 5. The actuating element 9, in turn, has an abutment 18 preferably formed as a screw which can be adjusted to control the pivoting movement of the pressing finger 7.

Figure 4:
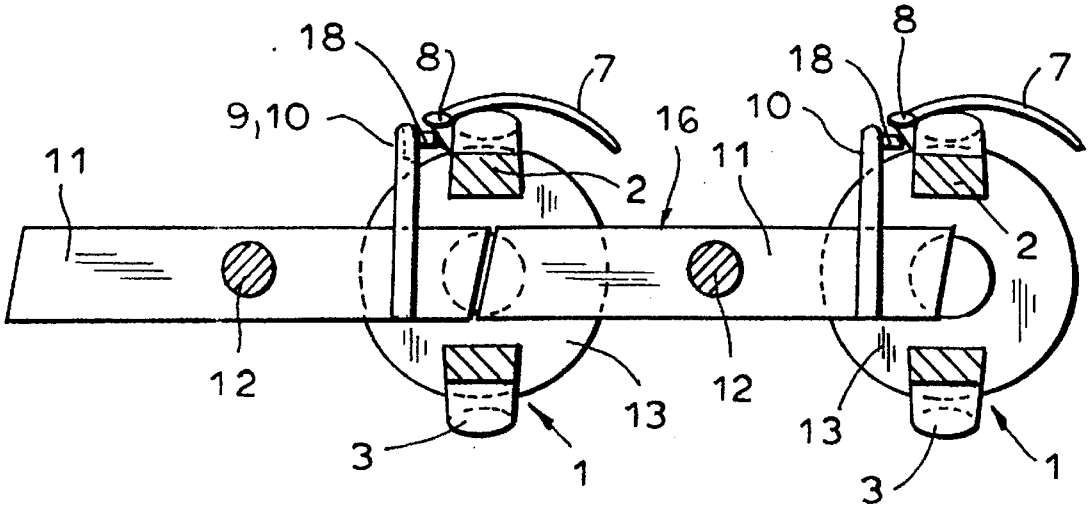

From FIGS. 2–4, it will be apparent that the holders 10 are provider on swingable rail segments 11 which, upon alignment, form the continuous track 16 previously mentioned. Each of the flyers 1 can be associated with a rail segment 11 which is swingable about a respective pivot pin 12 and carries the respective holder 10. Each of these pivot pins 12 also has a lever arm 17 affixed thereto (FIG. 1) which is articulated to a slidable bar 62 which extends parallel to the row of flyers, alongside the latter and is linearly displaceable by being pushed or pulled to swing the rail segments 11 into alignment (FIGS. 3 and 4) or out of the flyers (FIG. 2). As already noted, each of the rail segments 11 has a respective operating element 9 connected by a holder 10 to the rail segment.

FIG. 2 shows the rail segments 11 in their open states. The flyers are in their inclined orientations which enables the swinging of the rail segments 11 into the flyers, i.e. between the shanks thereof.

In FIG. 3 we have shown the rail segments 11 after they have been swung into position so that the operating elements 9 are in the paths of the levers 8. In FIG. 4 we have shown the position of the assembly after the flyers 1 have been rotated through a certain angle in the counterclockwise sense into positions in which their arms 2, 3 lie athwart the rail 16 to permit the train of carriages 15 with the full bobbins to pass freely between the arms of the flyers. In this position, each of the sheet metal lugs 8 engages the respective operating element 9 and each pressing finger is rotated out of its working position into the respective outwardly swung position as is clearly visible in FIG. 4. This position, with the pressing finger 7 lifted away from the bobbins, is retained until the suspension carriage has carried the bobbins away from the working stations and the full bobbins have been replaced by sleeves and the individual rail segments returned to the open position shown in FIG. 2.

The system of the invention is suitable not only for roving frames having rail segments swingable about vertical axes but also for roving frames in which the rail segments are movable otherwise, e.g. as shown in German patent document 44 06 488 (U.S. patent application Ser. No. 395,061 filed 2 Feb. 1995 U.S. Pat. No. 5,522,210). It is important that the abutment 16 in such cases be brought into the path of the lever 8, i.e. the lug, before or while the flyer rotation is reversed. The reversal of the flyer from the position shown in FIG. 3 into the position shown in FIG. 4 is only required for the special construction of the rotatable rail segment 11. The flyer 1 must be located in an inclined position to allow the rail segment 11 to be swung between the arms of the flyer and must again be rotated to lie athwart the track 16 while the bobbins are carried off. In other constructions for movable rail segments reverse rotation of the flyer 1 need not be necessary.

In an embodiment of the invention in which no suspension rail segments are used (see FIG. 5), the operating elements 9 can be mounted on a shaft 65 angularly oscillatable on the flyer rail 70 to swing the operating element 9' between the broken-line and solid-line positions shown. In the broken-line position, the operating element 9' clears the flyer. In the solid-line position, however, the adjustable abutment 18 of the operating element 9' is brought into the orbit of the lever 8, i.e. the sheet metal lug affixed to the rod 4.

A reverse rotation of the flyer 1 can be effected by analogy of FIGS. 1–4 to cause the pressing finger 7 to be swung out of the region of the full bobbin. In this system as well the flyer can be reverse-rotated between positions similar to that shown in FIGS. 3 and 4. However, this reverse rotation is not necessary if the shaft 65 is linearly shiftable perpendicular to the plane of the paper in FIG. 5 by a distance corresponding to the displacement required to lift the finger from the bobbin. In that case, the flyer can be brought to stand-still so that it is fully athwart the vertical median plane through the flyer row in a position corresponding to FIG. 4, whereupon the linear movement of the shaft 65 can effect the outward swinging of the fingers.

Figure 6:
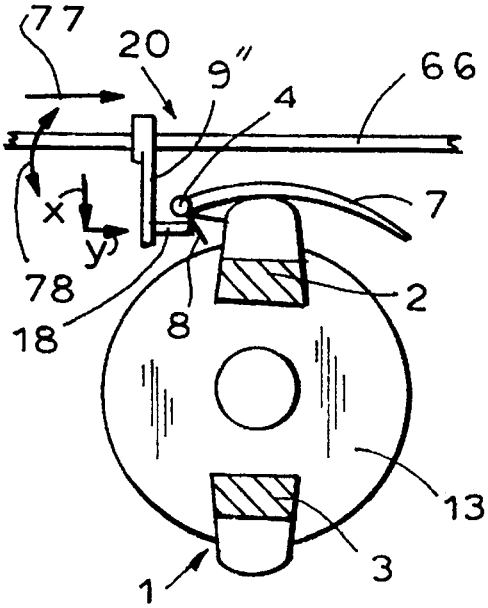
FIGS. 6–10 are views from above showing flyers and respective operating elements in other embodiments.

The shaft 6 of this type is shown in FIG. 6 at 66 and thus can be linearly shifted in the direction of arrow 77 and angularly swung in the direction of arrow 78, the latter movement bringing the abutment 18 into the orbit of the deflectable lever 8 while the former, i.e. the movement in the Y direction, results in the swinging outwardly of the finger 7.

Figure 7:
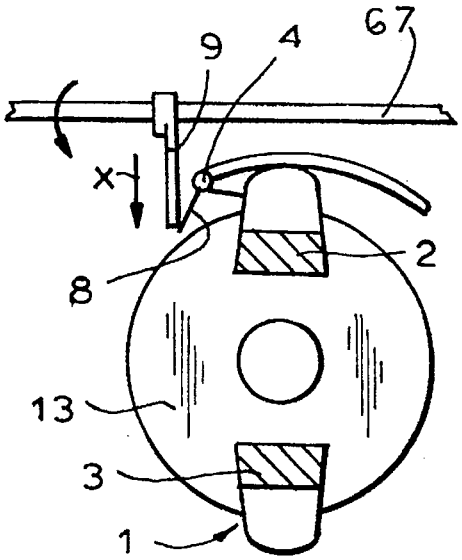

In the embodiment of FIG. 7, the surface of lever 8 is such that this lever is displaced solely by the swinging of the actuating element 9" on the shaft 67 into the position shown in FIG. 7 so that neither a reverse rotation of the flyer 1 nor a linear displacement of the shaft 67 is required.

Figure 8:
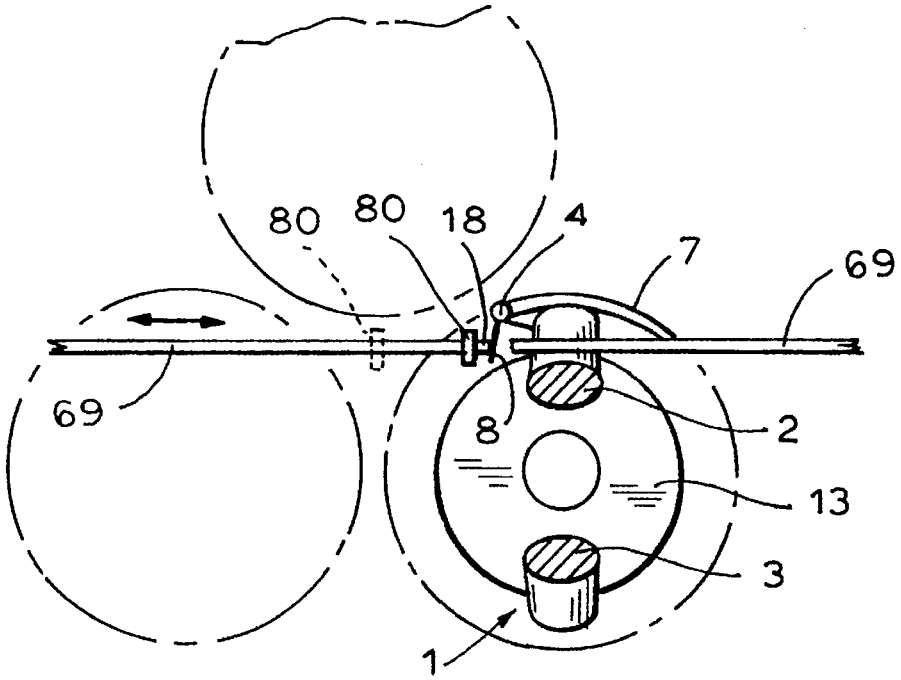

In FIG. 8 the abutment 18 is provided on a holder 80 extending vertically downwardly from a support bar 69. This holder is moved from its broken-line rest position to the right into its active position by linear displacement of the bar 69 and thus brought into the orbit of the respective lever 8 on its flyer. In this embodiment the bar 69 need only be linearly displaced to actuate the pressing fingers 7.

Figure 9:
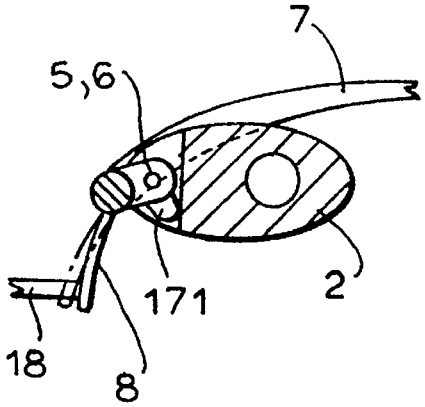

To effect a uniform outward swing of all of the pressing fingers 7 by the same angular displacement, adjustment of the individual elements may be required. To avoid this, as shown in FIG. 9, the effect of the abutment 16 on the lever 8 can be elastic in that the lever 8 can be composed of a leaf-spring. Alternatively, the abutment 18 may be spring-loaded. The pivot angle of the pressing finger 7 is, in this case, limited by an abutment 171 so that the spring action takes up any fluctuation in the differences in engagement of members 8 and 18 and all of the pressing fingers 7 can be swung into identical positions.

Figure 10:
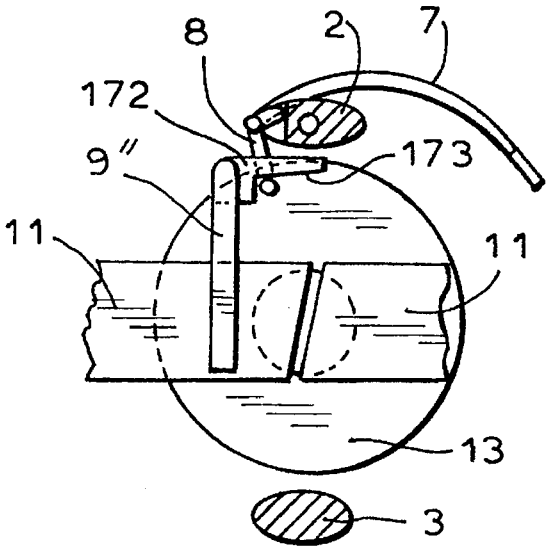

FIG. 10 shows that it is possible to fix the pressing finger in the outwardly swung position. In this case, the operating element 9" is provided with a fixing element 173 which can have the configuration of a guide curve or cam 173. The guide curve 173 draws the lever 8 into the open position and holds it. In this case, the pressing finger is held in its outwardly swung position as long as the rail segment 11 is in the inwardly swung position.

It is possible to exchange the abutment 18 and the lever 8 with the abutment 18.being then offset to the pivot axis 5 of the pressing finger rod 4 against the rotary axis of the flyer 1.

Figure 11:
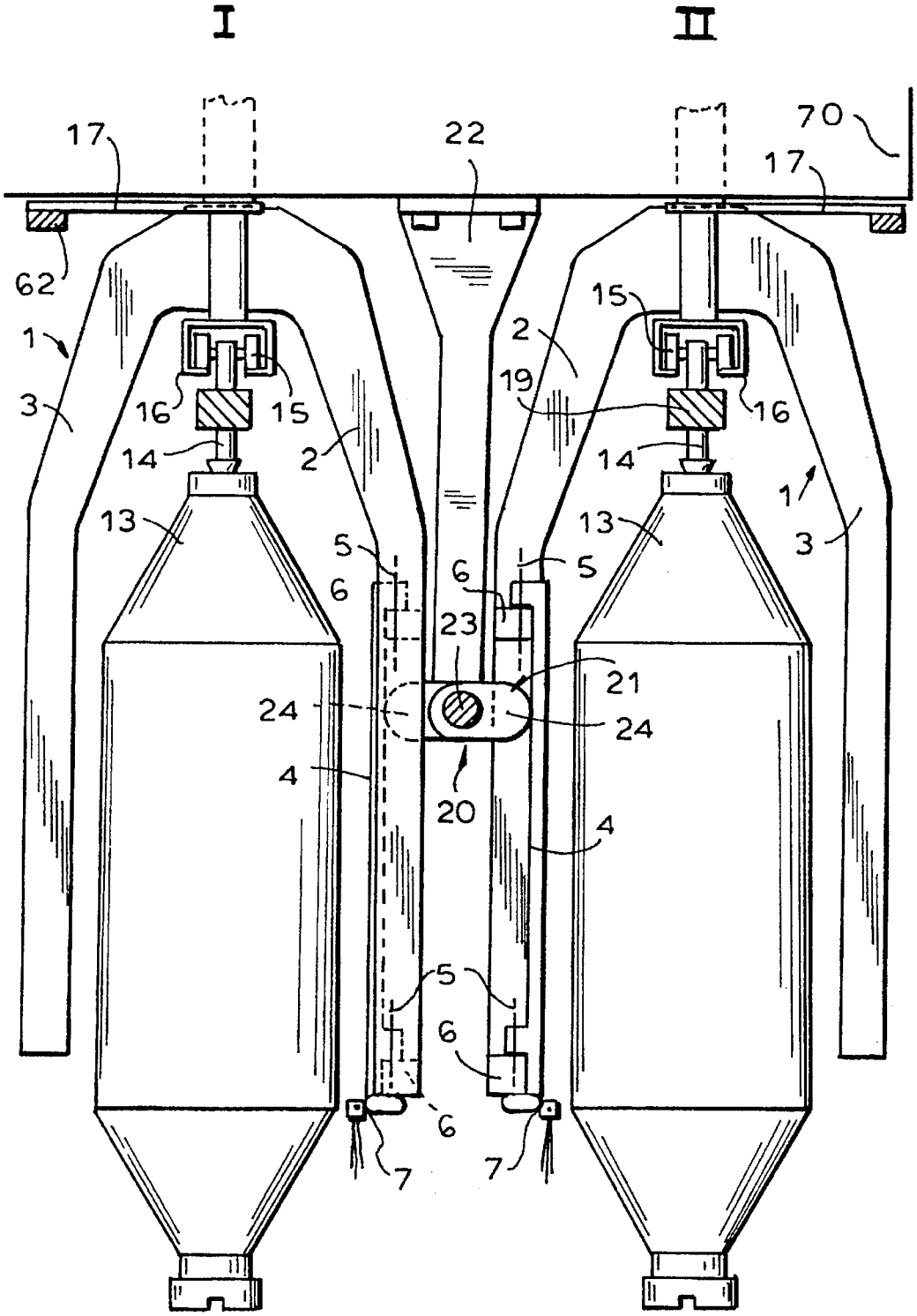
FIG. 11 is a schematic side view of flyers in a two-row roving frame having their pressing fingers swung outwardly.
Figure 12:
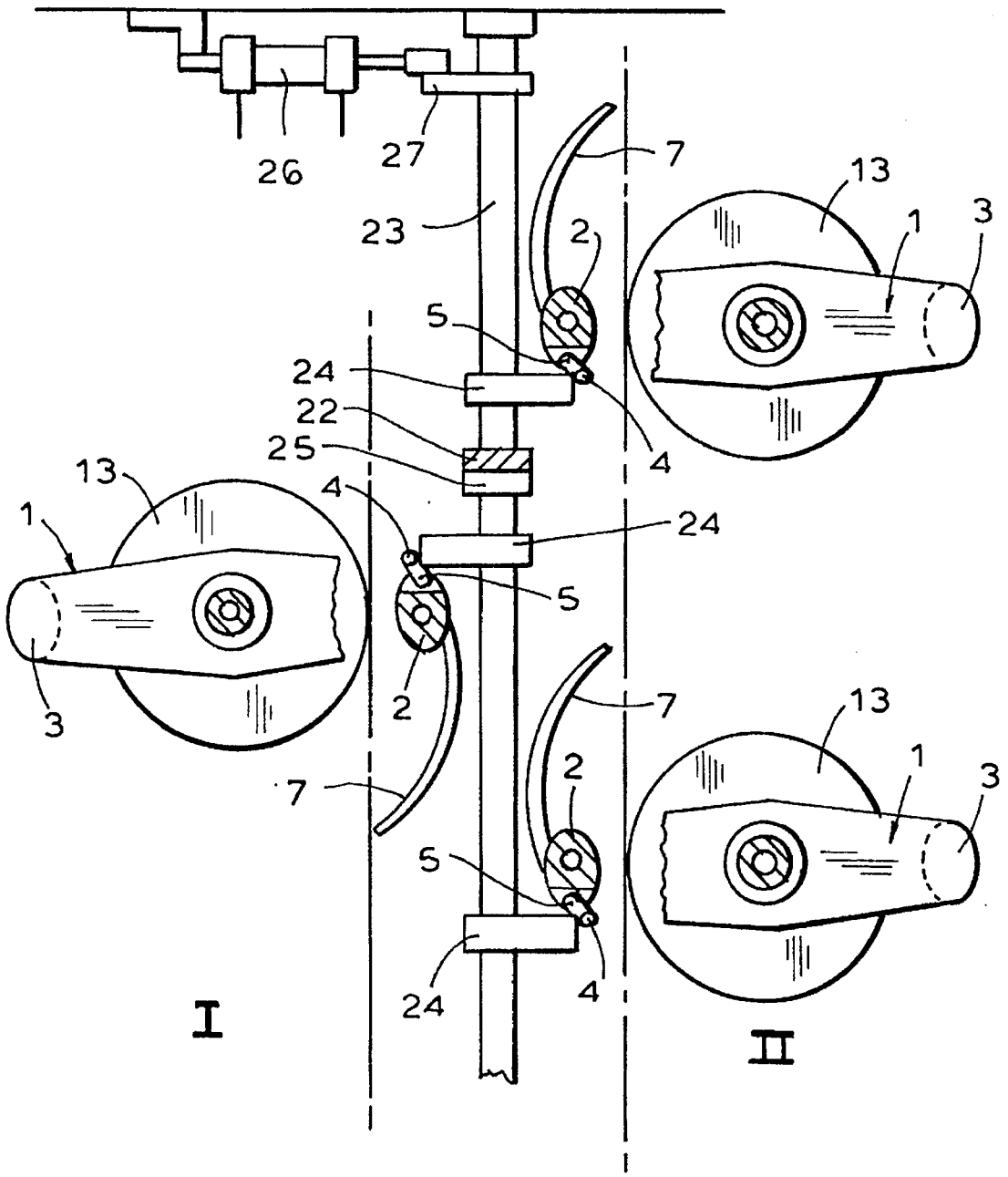
FIG. 12 is a plan view of the embodiment of FIG. 11, partly broken away.

FIG. 11 and 12 show a two-row system wherein the flyer rail 70 carries two rows of flyers I and II. Each of the flyers 1 has two arms or shanks 2, 3 and on the arms 2 of the flyers' journals 6 define a pivot axis 5 for the respective pressing finger rod 4. At their lower ends the pressing fingers 7 are mounted on the rods 4 and, for the two bobbins of the adjoining rows, swing in opposite senses.

As has been described, the bobbins 13 are suspended by hangers 14 from the rail carriages 15 which are displaced in respective tracks 16.

Each flyer 1 has a respective rail segment which is displaced by a respective lever 17 by the bars 62 linearly shiftable along the flyer rail 70.

To retain the pressing fingers 7 in the outwardly swung position as is shown in FIGS. 11 and 12, the device 20 has its actuating elements 21 engageable with the bars 4 on which the fingers 7 are mounted directly. The actuating elements 20 have cams 24 which are affixed to a pivot shaft 23 which, when rotated into the position shown in FIG. 11, interposes the cams 24 into the orbit of the rods 4.

As is also apparent from FIGS. 11 and 12, the pivot shaft 23 runs parallel to the rows of flyers and is journaled in bearings 25 on the flyer rail 10 of the roving frame. The shaft 23 (FIG. 12) runs at a right angle to the pivot axes 5 of the pressing fingers 7 and is located between the two rows of flyers. For each work station a respective cam 24 is provided. The cams are alternately offset from one another by 180° about the axis of the shaft 23 and thus engage alternately the rod 4 of a flyer of the row I and a flyer of the row II successively along the shaft 23. A quarter rotation of the shaft 23 from the position shown in FIG. 11 will enable the cams 24 to clear the rods 4 and to free the rods 4 and hence the pressing fingers 7 so that the latter can swing back inwardly, e.g. under spring force if desired.

Figure 13:
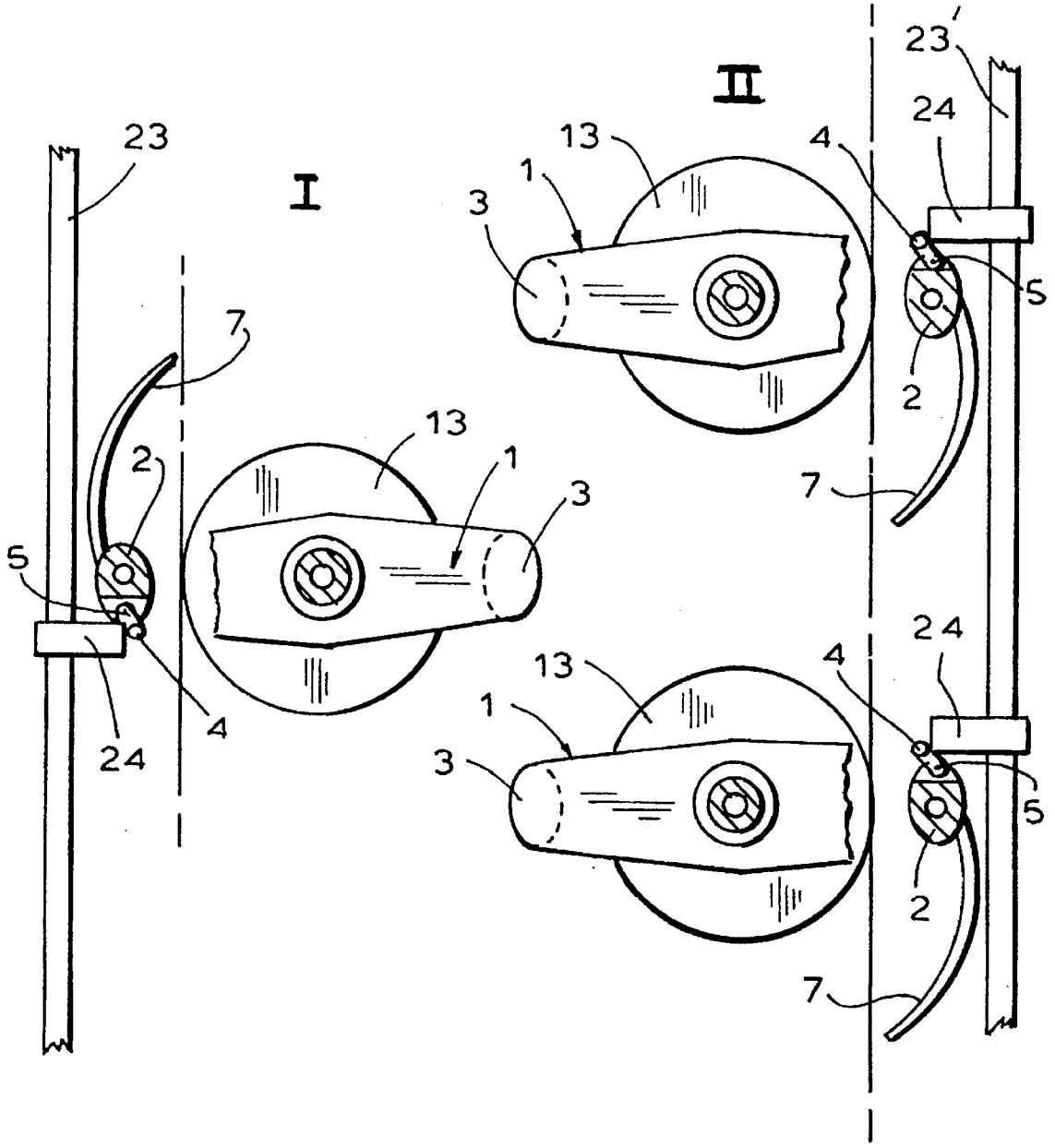
FIG. 13 is a view similar to FIG. 12 of a modification of that embodiment using two parallel pivot shafts.

When the flyers 1 are oriented for a bobbin change as shown in FIG. 11, the finger-carrying shanks 2 of the flyers are turned toward the shaft 23 and the cams 24 can be swung into the orbits of the rods 4. In that case a single shaft 23 can operate the fingers of both flyer rows. However, the system can also be constructed as shown in FIG. 13 wherein respective pivot shafts 23 and 23' can be provided along the outside of each of the flyer rows I, II, so that cams 24 of the respective shaft 23, 23" extend in only one direction from the respective shaft.

Figure 14:
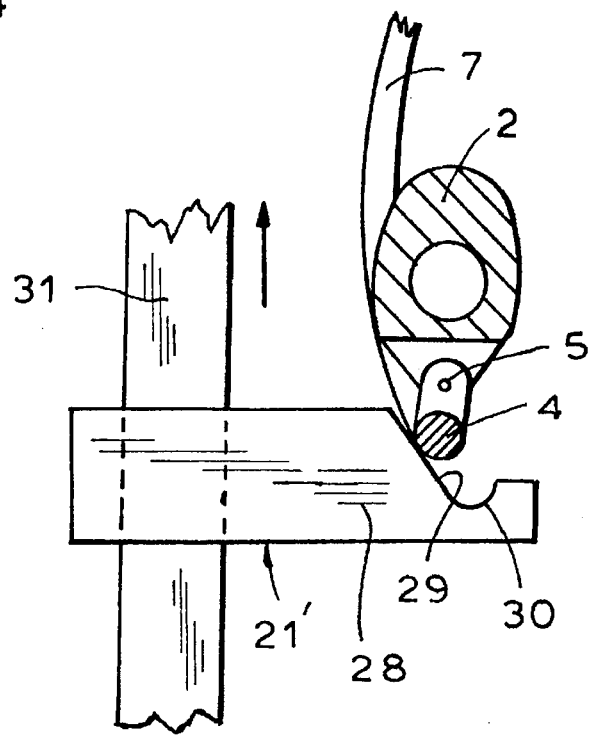
FIG. 14 is a detail plan view illustrating the cooperation of the pressing finger with a curved guide surface of the operating element.

FIG. 14 shows in a view drawn to a larger scale, a cam or the like 28 forming an operating element 21' whose guide curve 29 forms a rest or detent 30 which captures the rod 4 to retain the pressing finger 7 in the outwardly swung position. The cam 28 is fixed to a linearly-shiftable bar 31. When the latter is displaced in the direction of the arrow in FIG. 14, the pressing finger rod 4 slides in the guide curve 30 until the detent 30 is reached in which the rod 4 is held to retain the pressing finger in its outwardly swung position.

An embodiment which is not illustrated enables the cam with the guide curve to be displaced into the actuating position for the finger by a pivotal movement or by a combination of a linear and pivotal movement. In all cases, the cam with the guide curve can remain in the operating position until a rotary movement of the flyer carries the rod 4 into engagement therewith in an alternative actuating mode.

Figure 16:
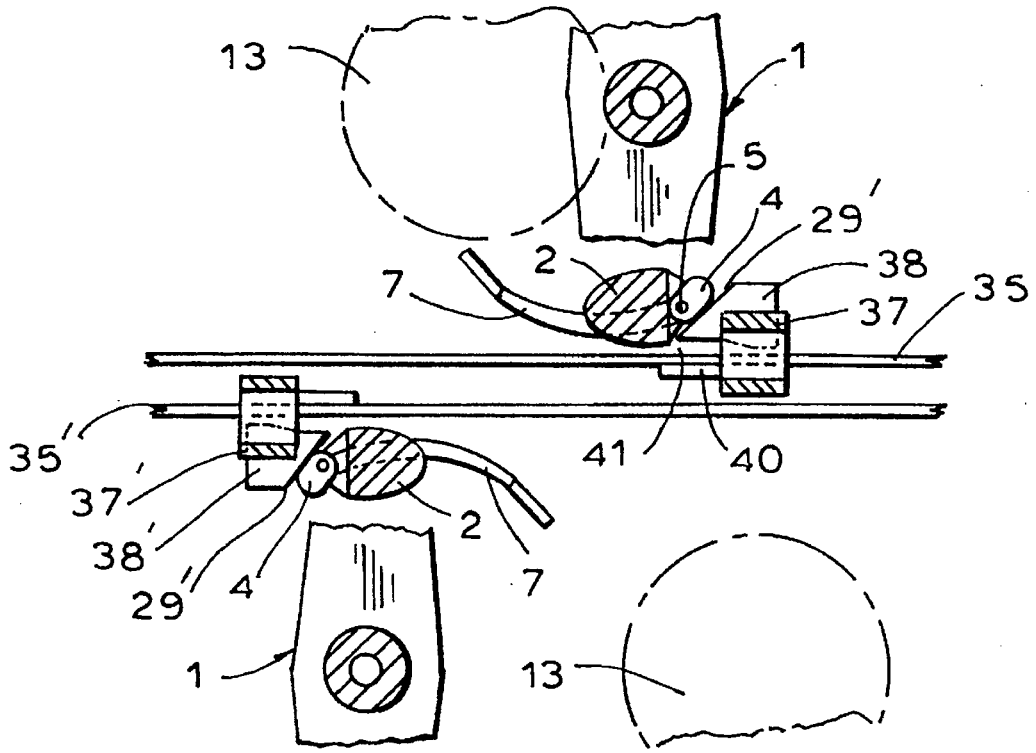
FIG. 16 is a plan view of the embodiment of FIG. 15, partly broken away.
Figure 15:
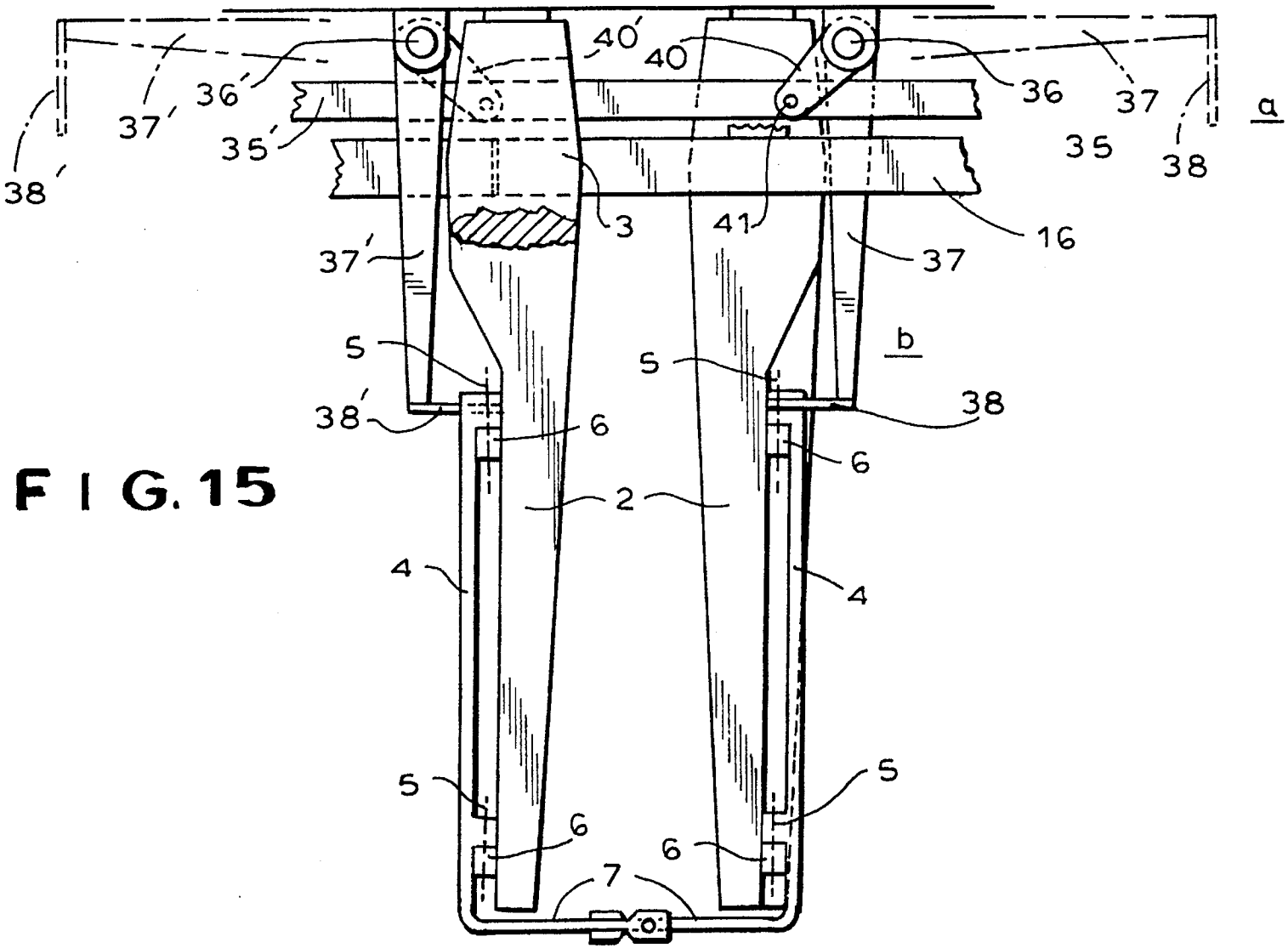
FIG. 15 is a side view of another embodiment of the invention with a deflector plate which is swingable to actuate the pressing fingers.

From FIGS. 15 and 16 it will be apparent that it is also possible to form the guide curve 29' as part of a deflector plate 38 or 38'. From FIG. 15 it will be clear that the deflector plates 38 can be provided with actuating arms 37 which can be connected with a horizontal shaft which can extend transversely to the row of flyers. The connection to the actuating rail 38 can be effected via a lever arm 40 and a pin 41.

The actuating rail 35, which can be moved back and forth, shifts the deflector plate 38 or 38' between the positions shown at a and b corresponding, respectively, to the rest position and to the operating position, respectively. In the working position the guide curve 29' (FIG. 16) engages the pressing finger rod 4. In the embodiment of FIGS. 15 and 16, two flyer rows can be provided each with a respective actuating rail 35, 35' whereby the actuating arms 37' deflect the plates 38', pivot shaft 36' and lever arm 40' operate in a manner similar to the operation of the elements 36, 37, 38 and 40 previously described.

FIG. 16 is a plan view in which the two guide curves 29' are shown in their downwardly swung positions as a result of displacement of the rails 35 and 35' to engage the rods 4 and retain the pressing fingers 7 reliably in their outwardly swung positions.

Figure 17:
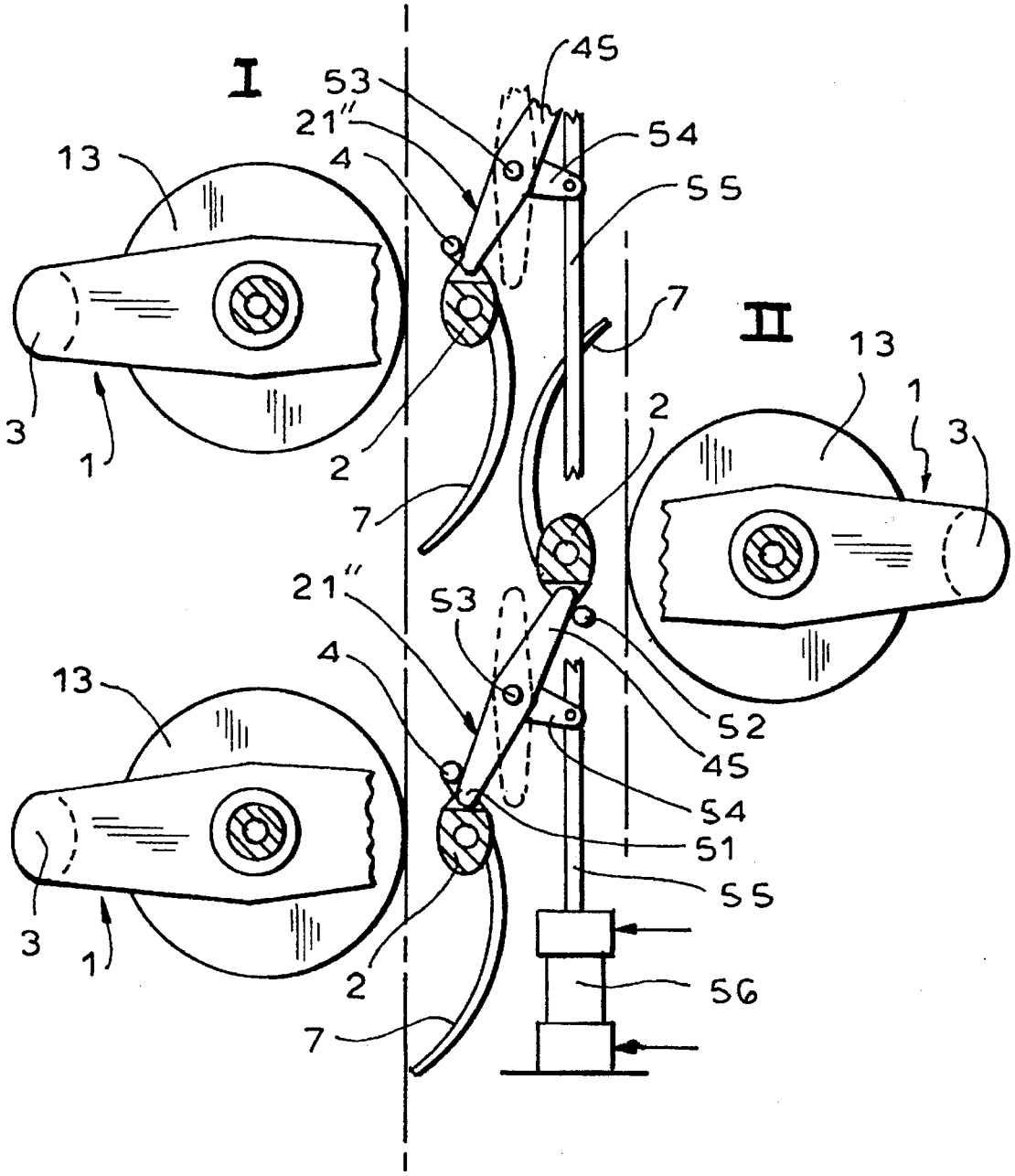
FIG. 17 is another plan view partly broken away illustrating still another embodiment where the actuating element is a double-arm lever.

FIG. 17 shows that the actuating elements 21" can also be formed by double-arm levers 45 whose ends 51 and 52 can engage the rods 4 and two flyers of different rows I and II. The levers 45 can be pivotally mounted at 53 and can be swung by arms 54 and an actuating rod 55 from the broken line positions shown into positions in which the levers are within the orbit of the rods 4. The actuating rod 55 is here displaced by a piston and cylinder unit 56 hydraulically or pneumatically the pressing fingers 7 are thereby retained in their outwardly swung positions until member 55 is shifted in the opposite direction to clear the rods 4. In every case using the operating elements 9, 9' 9" or 21, 21', 22' engage the rods 4 transversely to the pivot axis 5 to hold the pressing fingers 7 in the outwardly swung positions.

We claim:

1. A roving frame comprising:

a support;

at least one row of spindles on said support for receiving respective bobbins for spinning respective rovings at respective work stations;

a respective flyer at each of said stations cooperating with the spindle and having:

a flyer body at an end of the flyer and rotatable about a rotation axis aligned with the respective bobbin, and a pair of shanks attached to the respective flyer body and extending downwardly from the respective flyer body straddling the respective bobbin;

a respective pressing finger pivotally mounted on one of said shanks of each flyer swingable about a pivot axis inwardly toward and outwardly away from the respective bobbin into an inwardly swung position and an outwardly swung position for pressing turns of spun roving thereagainst in said inwardly swung position of the finger;

a pressing finger rod secured to and carrying said pressing finger at a lower end of said rod and being offset from said pivot axis, said rod extending from said pressing finger upwardly along said one of said shanks to an upper end of said rod; and a device cooperating with the pressing finger rods of said flyers and including a respective operating element engaging each rod transversely to the respective rod for retaining each pressing finger of a respective flyer in the respective outwardly swung position of the respective finger.

2. The roving frame defined in claim 1 wherein said upper end of each of said rods is provided with a lever and said device interposes said elements into paths of said levers upon rotation of the respective flyers, whereby said pressing fingers are swung into said outwardly swung positions and are held in said outwardly swung positions by engagement of said levers with said elements.

3. The roving frame defined in claim 2 wherein said device comprises a plurality of rail segments mounted on said support for alignment along said row, said bobbins being mountable on bobbin carriages guidable along said rail segments upon alignment thereof, said elements being provided on said rail segments.

4. The roving frame defined in claim 3 wherein each of said flyers is provided with a respective one of said rail segments mounted on the respective flyer and each of said segments has a respective one of said operating elements mounted on the respective segment.

5. The roving frame defined in claim 3 wherein each of said operating elements has a configuration of an abutment engageable by and cooperating with a respective one of said levers.

6. The roving frame defined in claim 5 wherein each of said abutments is a pin engaging the respective lever and retaining the respective lever in an outwardly swung position of the respective pressing finger.

7. The roving frame defined in claim 1 wherein said device, said rods and said pressing fingers are constructed and arranged to fix the pressing fingers in the respective outwardly swung positions.

8. A roving frame comprising:

a support;

at least one row of spindles on said support for receiving respective bobbins for spinning respective rovings at respective work stations;

a respective flyer at each of said stations cooperating with the spindle and having:

a flyer body at an end of the flyer and rotatable about a rotation axis aligned with the respective bobbin, and a pair of shanks attached to the respective flyer body and extending downwardly from the respective flyer body straddling the respective bobbin;

a respective pressing finger pivotally mounted on one of said shanks of each flyer swingable about a pivot axis inwardly toward and outwardly away from the respective bobbin into an inwardly swung position and an outwardly swung position for pressing turns of spun roving thereagainst in said inwardly swung position of the finger;

a pressing finger rod carrying said pressing finger at a lower end of said rod and being offset from said pivot axis, said rod extending from said pressing finger upwardly along said one of said shanks to an upper end of said rod; and a device cooperating with the pressing finger rods of said flyers and including a respective operating element engaging each rod transversely to the respective rod for retaining each pressing finger of a respective flyer in the respective outwardly swung position of the respective finger said upper end of each of said rods is provided with a lever and said device interposes said elements into paths of said levers upon rotation of the respective flyers, whereby said pressing fingers are swung into said outwardly swung positions and are held in said outwardly swung positions by engagement of said levers with said elements, said device comprising at least one pivot shaft on which said operating element is mounted.

9. The roving frame defined in claim 8 wherein said pivot shaft is mounted so as to be limitedly shiftable in an axial direction along said row.

10. A roving frame comprising:

a support;

at least one row of spindles on said support for receiving respective bobbins for spinning respective rovings at respective work stations;

a respective flyer at each of said stations cooperating with the spindle and having:

a flyer body at an end of the flyer and rotatable about a rotation axis aligned with the respective bobbin, and a pair of shanks attached to the respective flyer body and extending downwardly from the respective flyer body straddling the respective bobbin;

a respective pressing finger pivotally mounted on one of said shanks of each flyer swingable about a pivot axis inwardly toward and outwardly away from the respective bobbin into an inwardly swung position and an outwardly swung position for pressing turns of spun roving thereagainst in said inwardly swung position of the finger;

a pressing finger rod carrying said pressing finger at a lower end of said rod and being offset from said pivot axis, said rod extending from said pressing finger upwardly along said one of said shanks to an upper end of said rod; and a device cooperating with the pressing finger rods of said flyers and including a respective operating element engaging each rod transversely to the respective rod for retaining each pressing finger of a respective flyer in the respective outwardly swung position of the respective finger, said operating elements being constructed and arranged for displacement with at least one of a linear shifting component and a pivoting component of movement into engagement with the respective pressing finger rods for swinging of said pressing fingers into said outwardly swung positions.

11. The roving frame defined in claim 10 wherein said device comprises at least one pivot shaft and each operating element is a cam on said shaft pivotable into and out of engagement with the respective rod on said shaft with said pivoting component of movement.

12. The roving frame defined in claim 11 wherein said shaft extends at a right angle to said pivot axis and along said row, said shaft having a respective cam for the flyer of each work station.

13. The roving frame defined in claim 12 wherein two rows of said work stations are provided on said support and each of said rows is provided with a respective pivot shaft carrying said cams cooperating with the flyers of the respective row.

14. The roving frame defined in claim 12 wherein two rows of said work stations are provided on said support and said support shaft extends between said rows and has said cams angularly offset by about 180° from one another alternating along said shaft and cooperating with the flyers of the respective rows.

15. The roving frame defined in claim 10 wherein each of said elements has a curved surface along which a cam follower of the respective rod is guided and introduced into a path of the respective cam follower by said displacement of the respective element.

16. The roving frame defined in claim 15 wherein said curved surface has a detent portion for retaining the respective pressing finger in its outwardly swung position.

17. The roving frame defined in claim 15 wherein said elements are mounted on a linearly shiftable rod displaceable with said shifting component.

18. The roving frame defined in claim 17 wherein said linearly shiftable rod extends at a right angle to said pivot axes and along said row with each of said elements having a respective curved surface cooperating with a respective flyer of the row.

19. The roving frame defined in claim 17 wherein two rows of said work stations are provided on said support and said linearly shiftable rod extends between said rows and has said elements with respective curved surfaces offset by about 180° from one another alternating along said linearly shiftable rod and cooperating with the flyers of the respective rows.

20. The roving frame defined in claim 15 wherein said curved surface is formed as part of a deflector plate connected by intermediate elements to an actuating rail.

21. The roving frame defined in claim 20 wherein two rows of said work stations are provided on said support and two parallel oppositely movable actuating rails are provided, one of the rails being formed with deflector plates cooperating with the flyers of one of said rows, the other of said rails being formed with said deflector plates offset by 180° from the deflector plates of said one of said rails and cooperating with the flyers of the other row.

22. The roving frame defined in claim 10 wherein two rows of said work stations are provided on said support and each of said operating elements is a double-arm lever cooperating with flyers in each of the rows and displaceable with said pivoting component of movement.

23. The roving frame defined in claim 10 wherein said elements are magnetically or pneumatically operated to cooperate with the respective rods.

* * * * *